US006681754B1

(12) United States Patent
Angeloni

(10) Patent No.: US 6,681,754 B1
(45) Date of Patent: Jan. 27, 2004

(54) CABLE LIFT ARROW REST

(76) Inventor: Joseph J. Angeloni, 42 Electric St., Peckville, PA (US) 18452

( * ) Notice: Subject to any disclaimer, the term of this patent is extended or adjusted under 35 U.S.C. 154(b) by 0 days.

(21) Appl. No.: 10/346,915

(22) Filed: Jan. 15, 2003

(51) Int. Cl.[7] ..... F41B 5/00
(52) U.S. Cl. ..... 124/44.5
(58) Field of Search ..... 124/23.1, 24.1, 124/41.1, 44.5, 86

(56) References Cited

U.S. PATENT DOCUMENTS

| | | | | |
|---|---|---|---|---|
| 2,975,780 A | | 3/1961 | Fisher | |
| 3,504,659 A | | 4/1970 | Babington | |
| 4,071,014 A | | 1/1978 | Trotter | |
| 4,287,868 A | | 9/1981 | Schiff | |
| 4,492,214 A | | 1/1985 | Kielhoffer | |
| 4,865,007 A | | 9/1989 | Saunders | |
| 4,865,008 A | | 9/1989 | Troncoso | |
| 4,879,988 A | | 11/1989 | Larson | |
| 4,886,038 A | | 12/1989 | Betters | |
| 4,903,678 A | | 2/1990 | Walker | |
| 4,917,070 A | | 4/1990 | Townsend | |
| 5,005,554 A | | 4/1991 | Shepley et al. | |
| 5,022,378 A | | 6/1991 | Rhodehouse et al. | |
| 5,140,972 A | | 8/1992 | Fisk | |
| 5,146,908 A | | 9/1992 | Larson | |
| 5,161,514 A | | 11/1992 | Cary | |
| 5,205,268 A | | 4/1993 | Savage | |
| 5,415,154 A | | 5/1995 | Angeloni | |
| 5,697,356 A | * | 12/1997 | Chappell | 124/44.5 |
| 5,944,005 A | * | 8/1999 | Schiff | 124/44.5 |
| 6,591,823 B1 | * | 7/2003 | Keller | 124/44.5 |

* cited by examiner

*Primary Examiner*—Jacob K Ackun
(74) *Attorney, Agent, or Firm*—Gerald E. Helget; Nelson R. Capes; Briggs and Morgan

(57) ABSTRACT

An arrow rest assembly for use with a compound bow, the compound bow having a riser, a bowstring, and a tuning cable and a cable guide having a pulley receiving the tuning cable, so that when the bowstring is drawn, the tuning cable moves downwardly without moving rearwardly, and when the bowstring is released the tuning cable moves upwardly without moving forwardly. The arrow rest assembly includes a first arm pivotally attached to the riser; a second arm connected to the first arm, the second arm receiving an arrow rest; a third arm pivotally attached to the first arm, the third arm having a first end adjacent the first arm and a second end; and a cable attachment at the second end of the third arm, the cable attachment securely attached to the tuning cable. Movement of the bowstring away from the riser causes the third arm to move downwardly and forwardly, in turn causing the first arm to pivot upwardly on the riser thereby lifting the second arm and arrow rest upwardly, and release of the bowstring causes the third arm to move upwardly and rearwardly, in turn causing the first arm to pivot downwardly on the riser thereby rapidly lowering the second arm and the arrow rest downwardly.

12 Claims, 4 Drawing Sheets

CABLE LIFT ARROW REST

BACKGROUND OF THE INVENTION

1. Field of the Invention

The present invention relates to an arrow rest for use with a compound bow.

2. Description of the Related Art

In the sport of archery, compound bows exist which, unlike standard long bows, comprise a plurality of pulleys. The pulleys cooperate with tuning cables and the bowstring to enable an archer to hold the bowstring in a drawn position with ease.

Compound bows can be used with various types of arrows. Arrows typically have three or more feathers or vanes, which are commonly known as fletching. The fletching may extend radially outward perpendicularly from the arrow shaft. Alternatively, the fletching may extend radially outward from the shaft while being helixed slightly to induce spin on the arrow and thereby facilitate arrow flight.

Whether a compound bow is used for target shooting or hunting, it is desirable that the flight of the arrow shot from the bow be as accurate as possible. A major factor affecting the accuracy of the arrow flight is the arrow rest upon which the arrow lies when loaded into the bow. That is, the fletching of the arrow often strikes the arrow rest when the arrow is released from the bow, thus impeding the smooth flight of the arrow.

Numerous arrow rests exist, each being designed to minimize contact with the arrow fletching and/or to compensate for the deflection of the arrow as it passes over the arrow rest. Often, an archer will choose arrows having a fletching configuration best suited for use with a particular type of arrow rest or vice versa.

As shown in U.S. Pat. No. 4,879,988, and, for example, U.S. Pat. Nos. 4,865,007, 4,865,008, it is desirable to have an overdraw assembly having an arrow rest that moves out of the path of the arrow when the arrow is released. As described in these patents, the fletching strikes the arrow rest and moves the arrow rest out of position, thus allowing only minimal contact between the arrow rest and fletching and providing a more accurate trajectory. Furthermore, damage to the fletching is minimized. Nevertheless, even though such arrow rest devices mounted on overdraw assemblies are intended to provide a flatter trajectory, the resistance caused by the fletching striking these arrow rests still adversely affects the path of the arrow and also damages the fletching, although to a lesser degree.

U.S. Pat. No. 4,071,014 teaches an arrow rest assembly that automatically, upon release of the bowstring, springs out of the path of the arrow. In this arrangement, it is not necessary for the fletching of the arrow to strike the arrow rest to move the arrow rest out of the path of the arrow. However, such an assembly is incorporated into the handle portion of the frame of the compound bow and does not provide an overdraw feature. Hence, it was desirable to develop an arrow rest which is mounted to an overdraw assembly and automatically falls out of the arrow's path without interfering with the fletching of the arrow.

Such an apparatus is described, for example, in U.S. Pat. No. 5,161,514. In that apparatus, the arrow rest and overdraw assembly is mounted to the frame of the compound bow and comprises a special hollow rod extending rearwardly from the frame. A springloaded release mechanism is attached to the hollow rod at an end of the rod closest to the frame. A cable slide is disposed about the hollow rod and attached to the tension cables (tuning cables) of the bow to slidably move along the rod when the bow is drawn back. This action allows the spring loaded mechanism to lift the arrow rest and consequently lift the arrow to a position for firing.

When the arrow is released, the cable slide moves forward along the rod and cooperates with a pin in the rod to forcibly compress the spring loaded mechanism and thereby move the arrow rest downward and away from the path of the arrow. Although such an apparatus achieves the object of providing an overdraw assembly having an arrow rest that automatically moves away from the path of the arrow so as to not interfere with the fletching, such a complicated apparatus has many inter-engaging and moving parts which are costly and highly susceptible to wear and tear. Furthermore, because a special hollow cable guard is needed, the apparatus is not adaptable with a standard cable guard on a standard compound bow.

In addition, the noise caused by the spring activated mechanism can scare a game animal such as a deer and consequently result in the hunter missing his intended target. These disadvantages thus render such an apparatus impractical and present a need for an overdraw and arrow rest assembly which is simple, quiet, inexpensive and less susceptible to wear and tear.

Compound bows normally have two or more lengths of cable trained over limb cable wheels or cams and spanning the length of the bow close to and about parallel to the bowstring. As the arrow is shot, its fletching may strike the cables, causing the fletching to become worn and reducing arrow accuracy.

A solution to this problem is a cable guard, as disclosed in U.S. Patent Nos. 4,452,222; 4,4542,732; and 6,178,958. Such cable guards generally consist of a rod attached at one end to the bow riser and extending therefrom beyond the cables when the bow is fully drawn and spaced laterally from the bow string sufficiently to avoid any interference therewith; and a cable retaining member or slide mounted on the rod that captures the bow cables.

However, the archer may in some cases let go of the bow or the bow may slip from his hand, causing the tension in the bowstring to cause the cable guard to strike and injure the archer. Hence, cable pulleys have been invented for cable guides. Cable pulleys have a pulley receiving the tuning cable, so that when the bowstring is drawn, the tuning cable moves downwardly without moving rearwardly, and when the bowstring is released the tuning cable moves upwardly without moving forwardly.

There is a need for an arrow rest for a compound bow that addresses the above problems and works with cable pulleys instead of a dangerous rod-like cable guards.

SUMMARY OF THE INVENTION

An arrow rest assembly for use with a compound bow, the compound bow having a riser, a bowstring, and a tuning cable, the arrow rest assembly comprising:

(a) a first arm pivotally attached to the riser;

(b) a second arm connected to the first arm, the second arm receiving an arrow rest;

(c) a third arm pivotally attached to the first arm, the third arm having a first end adjacent the first arm and a second end; and (d) a cable attachment at the second end of the third arm, the cable attachment securely attached to the tuning cable wherein movement of the bowstring away from the riser causes the third arm to move downwardly and forwardly, in turn causing the first arm to pivot upwardly on the riser thereby lifting the second arm and arrow rest upwardly, and wherein release of the bowstring causes the third arm to move upwardly and rearwardly, in turn causing the first arm to pivot downwardly on the riser thereby rapidly lowering the second arm and the arrow rest downwardly.

The invention also preferably comprises a cable guide having a pulley receiving the tuning cable, so that when the bowstring is drawn, the tuning cable moves downwardly without moving rearwardly, and when the bowstring is released the tuning cable moves upwardly without moving forwardly.

DETAILED DESCRIPTION OF THE PREFERRED EMBODIMENTS

Figure 1:
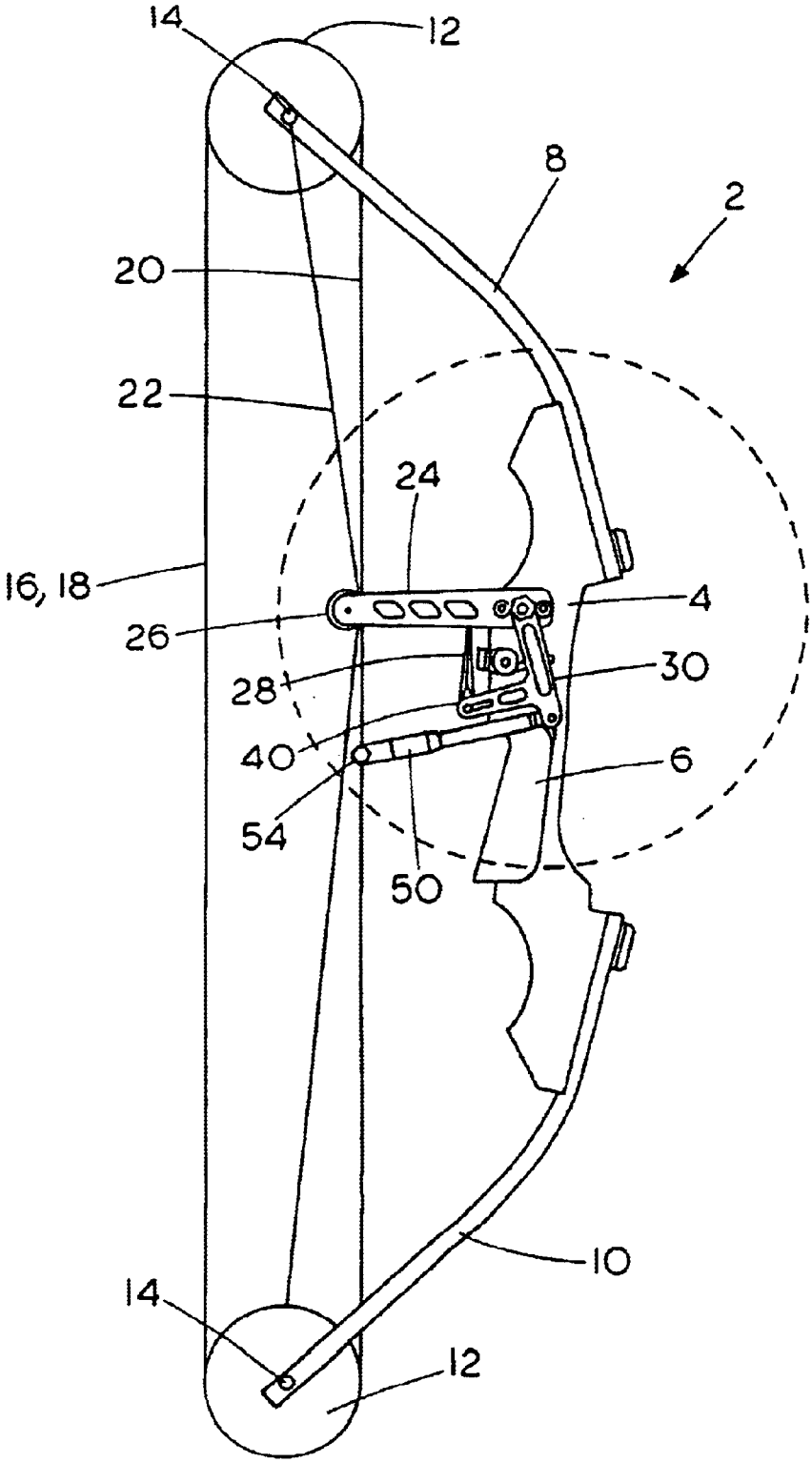
FIG. 1 is a right-side elevational view of a compound bow with the arrow rest assembly of the present invention, with the bowstring not drawn or having been released.
Figure 2:
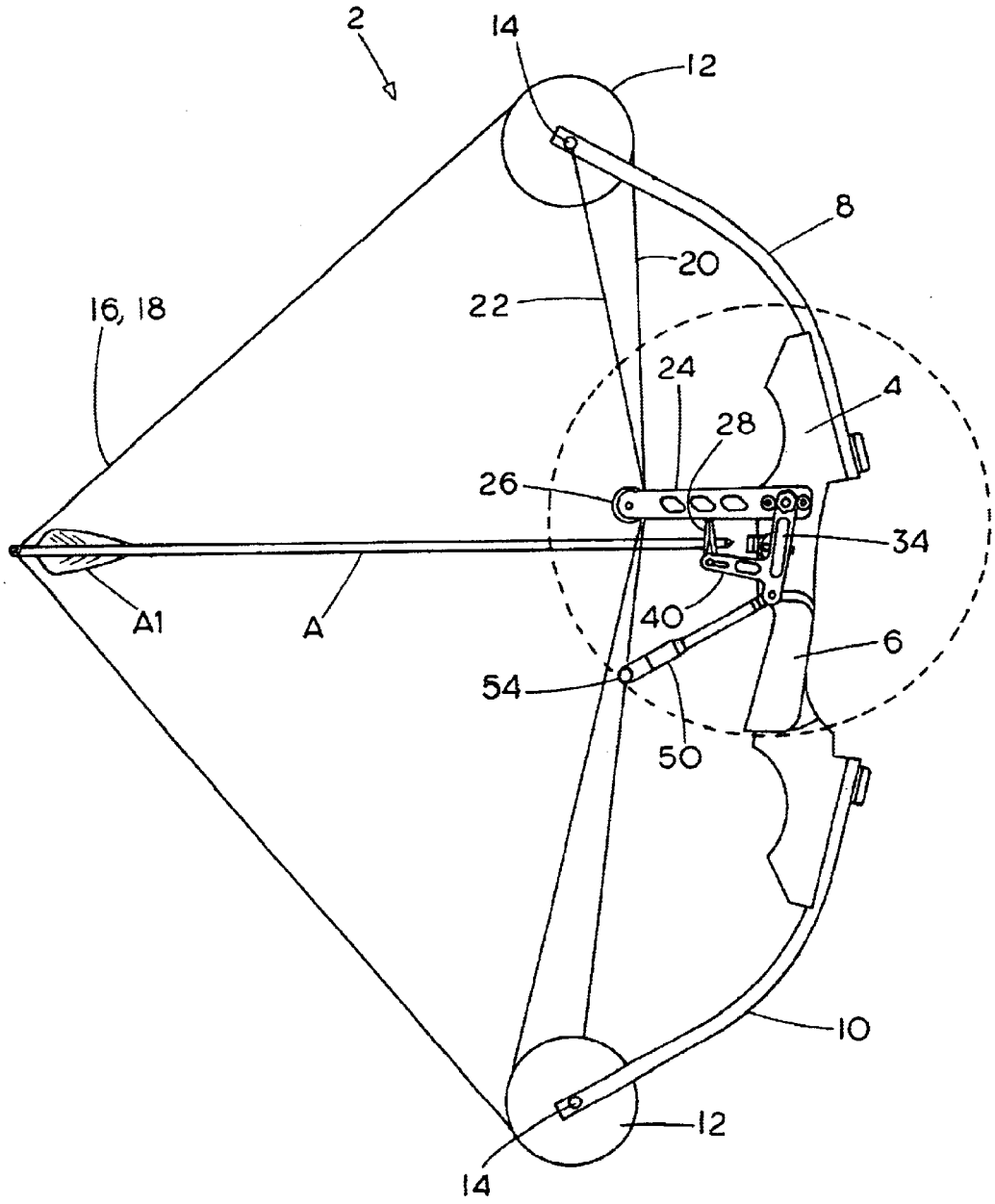
FIG. 2 is similar to FIG. 1, with the bowstring drawn.

A compound bow 2 using the present invention is shown in FIGS. 1 and 2 . The bow 2 includes a riser 4 with apertures 4*a*, 4*b*. Riser 4 has a handle portion 6. Riser 4 is connected at one end to an upper limb 8 and at the other end to a lower limb 10. A dual-feed cam 12 is mounted to an axial pin 14 which extends through the upper limb 8. A similar cam 12 may be mounted to the lower limb 10.

A cable 16 has a medial portion trained around the cam 12 to form a main cable section or bowstring 18 and a secondary return cable 20. The ends of cable 16 pass around eccentric peripheral groove portions of the cam 12 and are connected to it, so that when the bow is shot bowstring 18 and cable 20 will be fed out from cam 12. An anchor cable 22 is anchored at one end of the axle 14 which extends through the top of upper limb 8. The other end of anchor cable 22 passes around the other cam and is connected to it. In this manner, anchor cable 22 forms a direct connection between the limbs 8 and 10.

Figure 3:
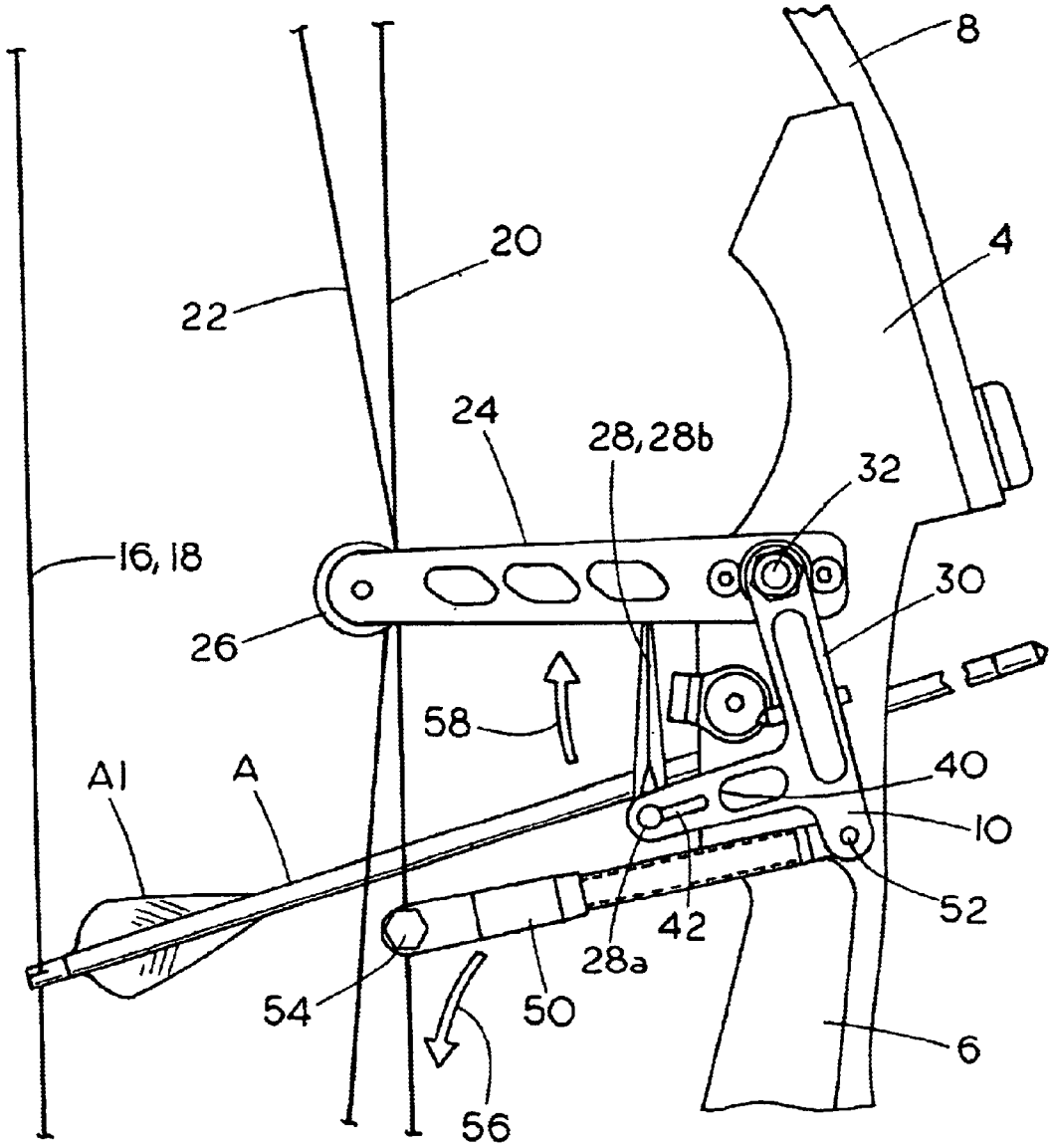
FIG. 3 is a detail view of the circled area of FIG. 1.
Figure 5:
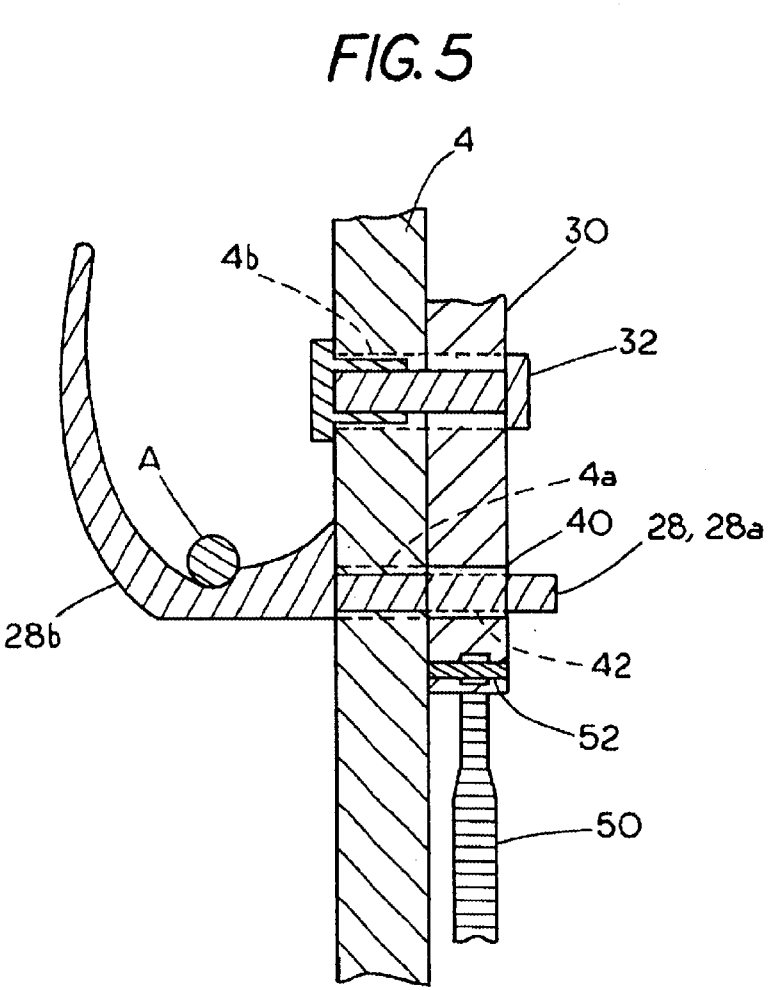
FIG. 5 is a partial rear view in cross section of a compound bow with the arrow rest assembly of the present invention.
Figure 4:
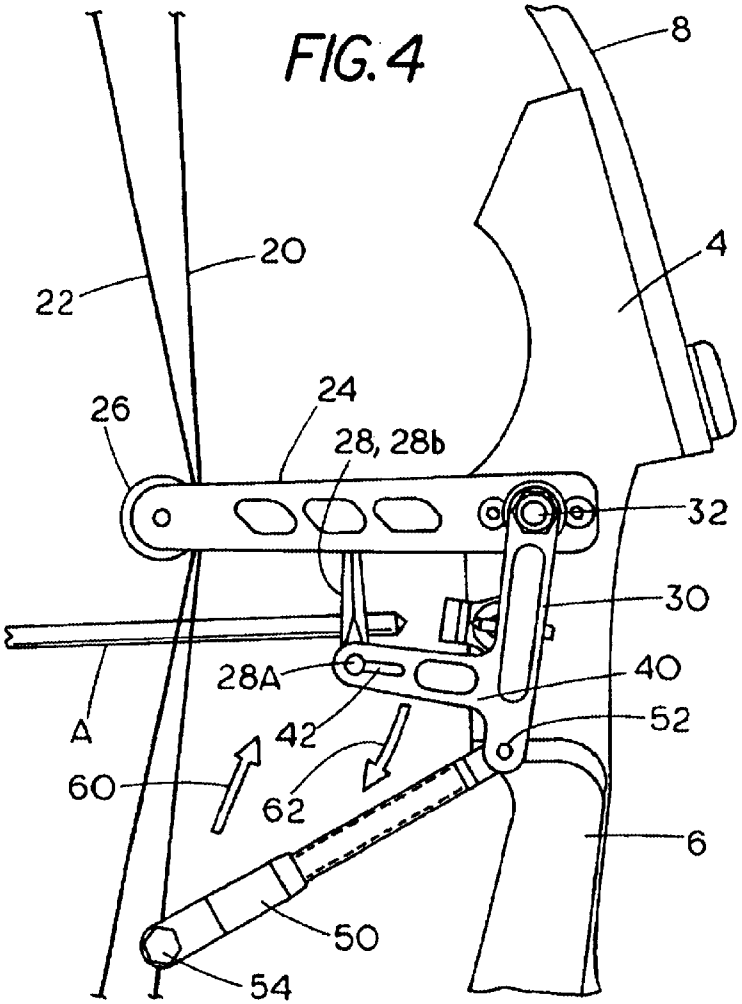
FIG. 4 is a detail view of the circled area of FIG. 2.

FIGS. 3 through 5 show a new type of cable guide 24. Cable guide 24 attaches to the riser 4, but unlike previous cable guides, there is no associated slider portion. Instead, tuning cables 20, 22 pass over a pulley 26 in one end of the cable guide 24. As the archer draws the bowstring back, cables 20, 22 glide freely along the pulley 26 without substantial rearward travel.

FIGS. 3 through 5 also show details of the arrow rest assembly 28 of the present invention. Arrow rest 28 has a straight portion or shank 28*a* and a curved rest portion 28*b* upon which rests arrow A. The bow riser 4 has a first aperture 4*a* through which the straight portion or shank 12*a* traverses the riser 4.

The arrow rest assembly 28 further comprises a first arm 30 which is pivotally attached to the riser 4, preferably by means of a fastener 32 penetrating the riser 4 through the second aperture 4*b*. The arrow rest assembly 28 further comprises a second arm 40 which receives the straight portion or shank 28 of the arrow rest 28 through a slot 42.

The arrow rest assembly 28 further comprises a third arm 50 pivotally attached to the first arm 30 by pivot pin 52. At the end of the third arm 50 opposite the pivot pin 52 is cable attachment 54, which securely grips the tuning cable 20. Attachment 54 clamps onto cable 20. Serving thread may also be used to secure third arm 50 to cable 20.

The consequence of replacing a standard cable guard with slider with the new cable guide 24 is that, instead of moving rearwardly as the archer draws the bowstring, cable 20 shortens between the cams 12. Because the third arm 50 is securely attached to the cable 20, this causes the third arm 50 to move downwardly (arrow 56), as shown by the arrow in FIG. 3. Because the first arm 30 is pivotally attached to the riser 4, this downward motion of the third arm 50 causes the first arm 30 to pivot on the third arm 50, thereby causing the second arm 40 with its attached arrow rest 28 to move upwardly as shown by arrow 58 in FIG. 3. Consequently, the arrow rest 28 and arrow A come to the firing position shown in FIGS. 2 and 4.

When the archer releases the bow string, the third arm 50, driven by the lengthening tuning cable 20, moves rapidly upward, as shown by arrow 60 in FIG. 4, causing the first arm to pivot on the third arm 50 and the second arm 40 with the attached arrow rest 28 to move downwardly, as shown by the arrow 62 in FIG. 4. This cause the arrow rest 28 to drop rapidly away from the arrow A, so that the fletchings A1 of the arrow A do not touch the arrow rest 28.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed:

1. An arrow rest assembly for use with a compound bow, the compound bow having a riser, a bowstring, and a tuning cable, the arrow rest assembly comprising:

(a) a first arm pivotally attached to the riser;

(b) a second arm connected to the first arm, the second arm having an arrow rest;

(c) a third arm with first and second ends is pivotally attached to the first and second arms at the first end; and (d) a cable attachment at the second end of the third arm, the cable attachment securely attached to the tuning cable wherein movement of the bowstring away from the riser causes the third arm to move downwardly and forwardly, in turn causing the first arm to pivot upwardly on the riser thereby lifting the second arm and arrow rest upwardly, and wherein release of the bowstring causes the third arm to move upwardly and rearwardly, in turn causing the first arm to pivot downwardly on the riser thereby rapidly lowering the second arm and the arrow rest downwardly.

2. The arrow rest assembly of claim 1, wherein the second arm is integrally molded with the first arm.

3. The arrow rest assembly of claim 1, wherein the cable attachment is pivotally attached to the third arm.

4. The arrow rest assembly of claim 1, further comprising a cable guide on the bow slidably engaging the tuning cable and attached to the riser.

5. The arrow rest assembly of claim 4, wherein the cable guide further comprises a pulley.

6. The arrow rest assembly of claim 1, wherein movement of the bowstring away from the riser causes the tuning cable to move downwardly without substantial rearward motion and wherein release of the bowstring causes the tuning cable to move upwardly without substantial forward motion.

7. An arrow rest assembly for use with a compound bow, the compound bow having a riser, a bowstring, and a tuning cable, the arrow rest assembly comprising:

(a) an arrow rest;

(b) means, adapted to couple to the riser, for moving the arrow rest in a substantially vertical direction between a first position and a second position; and (c) means, adapted to couple directly to the tuning cable, for causing the moving means to move the arrow rest to the second position when the bowstring is pulled in a direction away from the riser and the moving means to return the arrow rest to the first position when the bowstring is released.

8. The arrow rest assembly of claim 7, further comprising a cable guide on the bow attached to the riser for slidably engaging the tuning cable.

9. The arrow rest assembly of claim 8, wherein the cable guide further comprises a pulley.

10. The arrow rest assembly of claim 7, wherein movement of the bowstring away from the riser causes the tuning cable to move downwardly without substantial rearward motion and wherein release of the bowstring causes the tuning cable to move upwardly without substantial forward motion.

11. An arrow rest assembly for use with a compound bow, the compound bow having a riser, a bowstring, a tuning cable, and a pulley cable guide, the arrow rest assembly comprising:

(a) an arrow rest;

(b) means, adapted to couple to the riser, for moving the arrow rest in a substantially vertical direction between a first position and a second position, wherein the moving means further comprises a first arm pivotally attached to the riser and a second arm connected to the first arm, the second arm receiving the arrow rest; and (c) means, adapted to couple directly to the tuning cable, for causing the moving means to move the arrow rest to the second position when the bowstring is pulled in a direction away from the riser and the moving means to return the arrow rest to the first position when the bowstring is released, wherein the causing means further comprises a third arm pivotally attached to the first arm, the third arm having a first end adjacent the first arm and a second end, and a cable attachment at the second end of the third arm, the cable attachment securely attached to the tuning cable.

12. The arrow rest assembly of claim 11, wherein movement of the bowstring away from the riser causes the tuning cable to move downwardly without substantial rearward motion and wherein release of the bowstring causes the tuning cable to move upwardly without substantial forward motion.

* * * * *